US010906566B2

(12) United States Patent
Dede et al.

(10) Patent No.: US 10,906,566 B2
(45) Date of Patent: Feb. 2, 2021

(54) RUNNING GEAR PROVIDED WITH A PASSIVE HYDRAULIC WHEEL SET STEERING SYSTEM FOR A RAIL VEHICLE

(71) Applicant: Bombardier Transportation GmbH, Berlin (DE)

(72) Inventors: Jani Dede, Siegen (DE); Volker Brundisch, Netphen (DE)

(73) Assignee: Bombardier Transportation GmbH, Berlin (DE)

( * ) Notice: Subject to any disclaimer, the term of this patent is extended or adjusted under 35 U.S.C. 154(b) by 266 days.

(21) Appl. No.: 15/763,241

(22) PCT Filed: Sep. 27, 2016

(86) PCT No.: PCT/EP2016/072932
§ 371 (c)(1),
(2) Date: Mar. 26, 2018

(87) PCT Pub. No.: WO2017/055255
PCT Pub. Date: Apr. 6, 2017

(65) Prior Publication Data

US 2018/0281825 A1 Oct. 4, 2018

(30) Foreign Application Priority Data

Sep. 28, 2015 (GB) ..... 1517168.9

(51) Int. Cl.
*B61F 5/38* (2006.01)
*B61F 5/52* (2006.01)

(52) U.S. Cl.
CPC ..... *B61F 5/386* (2013.01); *B61F 5/52* (2013.01)

(58) Field of Classification Search
CPC ..... B61F 5/386
(Continued)

(56) References Cited

U.S. PATENT DOCUMENTS 4,135,456 A * 1/1979 Welsh ..... B61F 5/46 105/135
4,519,329 A * 5/1985 Vacher ..... B61F 5/383 105/168

(Continued)

FOREIGN PATENT DOCUMENTS

DE 1156835 B 11/1963
DE 3123858 A1 12/1982

(Continued)

*Primary Examiner* — Zachary L Kuhfuss
(74) *Attorney, Agent, or Firm* — The Webb Law Firm

(57) ABSTRACT

A running gear for a rail vehicle includes a front and a rear wheel sets, each provided with left and right wheels. A passive hydraulic wheel set steering system includes a control valve hydraulically connected to hydro-mechanical converters for converting motion of each of the wheels towards and away from the median transverse vertical plane. The control valve is movable between a first position in which the front left and right hydro-mechanical converter assemblies are disconnected from the rear left and right hydro-mechanical converter assemblies, and a second position in which each of the front left and right hydro-mechanical converter assemblies is connected to at least a respective one of the rear left and right hydro-mechanical converter assemblies.

20 Claims, 2 Drawing Sheets

(58) Field of Classification Search
USPC ..... 105/168
See application file for complete search history.

(56) References Cited

U.S. PATENT DOCUMENTS

| | | | | | |
|---|---|---|---|---|---|
| 4,640,198 | A * | 2/1987 | Haupl | B61F 5/386 | 105/168 |
| 5,277,127 | A * | 1/1994 | Euwijk | B61D 13/00 | 105/133 |
| 5,909,711 | A * | 6/1999 | Vogel | B61F 5/386 | 105/168 |
| 8,249,776 | B2 * | 8/2012 | Reimann | B61F 5/383 | 701/41 |
| 2008/0276611 | A1 * | 11/2008 | Gaile | B61D 3/10 | 60/545 |
| 2010/0294163 | A1 | 11/2010 | Walter et al. | | |
| 2013/0312634 | A1 * | 11/2013 | Smit | B61F 5/386 | 105/168 |
| 2018/0281825 | A1 * | 10/2018 | Dede | B61F 5/52 | |

FOREIGN PATENT DOCUMENTS

| | | | | |
|---|---|---|---|---|
| DE | 4343608 | A1 * | 7/1995 | B61F 5/386 |
| DE | 102008027474 | A1 * | 12/2009 | F16F 9/46 |
| EP | 0360783 | A2 | 3/1990 | |
| EP | 2065286 | A1 | 6/2009 | |
| EP | 2762377 | A1 | 8/2014 | |
| GB | 1542498 | A * | 3/1979 | B61F 5/386 |
| WO | 2007090825 | A2 | 8/2007 | |

* cited by examiner

RUNNING GEAR PROVIDED WITH A PASSIVE HYDRAULIC WHEEL SET STEERING SYSTEM FOR A RAIL VEHICLE

CROSS-REFERENCE TO RELATED APPLICATIONS

This application is the United States national phase of International Application No. PCT/EP2016/072932 filed Sep. 27, 2016, and claims priority to United Kingdom Patent Application No. 1517168.9 filed Sep. 28, 2015, the disclosures of which are hereby incorporated in their entirety by reference.

TECHNICAL FIELD OF THE INVENTION

The present invention relates to a running gear for a rail vehicle, provided with a passive hydraulic wheel set steering system.

BACKGROUND ART

A two-axle bogie for a rail vehicle described in DE 31 23 858 C2 is provided with a passive hydraulic wheel set steering system comprising: a pair of front left hydraulic cylinders for moving the left wheel of the front wheel set towards and away from a median transverse vertical plane of the bogie, a pair of front right hydraulic cylinders for moving the right wheel of the front wheel set towards and away from the median transverse vertical plane, a pair of rear left hydraulic cylinders for moving the left wheel of the rear wheel set towards and away from the median transverse vertical plane, a pair of rear right hydraulic cylinders for moving the left wheel of the rear wheel set towards and away from the median transverse vertical plane, and hydraulic connection to ensure that movements of the left, respectively right wheels of the front wheel set towards, respectively away from the median transverse vertical plane result in movements of the left, respectively right wheels of the front wheel set towards, respectively away from the median transverse vertical plane. In other words, the steering of the front and rear wheel sets is coordinated to negotiate tight curves of the track. This system, however, has no substantial benefit on wide curve or straight tracks, where it is rather considered as detrimental because of its tendency to increase wear and lateral acceleration.

EP2762377A1 discloses a running gear for a rail vehicle, comprising: a pair of wheel sets comprising a front wheel set and a rear wheel set respectively on a front side and a rear side of a median transverse vertical plane of the running gear, each of the front wheel set and rear wheel set having a left wheel and a right wheel, respectively on a left side and a right side of a median longitudinal vertical plane of the running gear, and a passive hydraulic wheel set steering system comprising: a front left hydro-mechanical converter assembly for converting motion of the left wheel of the front wheel set towards and away from the median transverse vertical plane into hydraulic energy and vice versa, a front right hydro-mechanical converter assembly for converting motion of the right wheel of the front wheel set towards and away from the median transverse vertical plane into hydraulic energy and vice versa, a rear left hydro-mechanical converter assembly for converting motion of the left wheel of the rear wheel set towards and away from the median transverse vertical plane into hydraulic energy and vice versa, a rear right hydro-mechanical converter assembly for converting motion of the right wheel of the rear wheel set towards and away from the median transverse vertical plane into hydraulic energy and vice versa, and a control valve assembly hydraulically connected to the front left, front right, rear left and rear right hydro-mechanical converter assemblies. The control valve assembly is movable between a first position, a second and a third position, each corresponding to an operating mode. In the first operating mode, each front converter one side of the running gear is connected to the rear converter on the opposite side of the running gear, so that the two wheel sets pivot in opposite directions about their respective vertical axes. In the second operating mode, each front converter on one side of the running gear is connected to the converter on the same side of the running gear so that the two wheel sets pivot in the same direction about their respective vertical axes. In the third operating mode, each converter is completely isolated, which means that no pivot motion of the wheel sets is possible.

Other, more sophisticated active wheel set steering systems are known, which can provide different steering behaviours depending on a series of parameters such as vehicle speed or angle of curvature of the track. However, such active systems, which involve pumps or motors for delivering power to steer the wheel sets, are more costly both in terms of initial cost and maintenance, in particular when taking into account the high standards of reliability and availability required from the rolling stock in public transportation.

SUMMARY OF THE INVENTION

The invention aims to provide a running gear with improved wheel set steering capabilities, which remains simple and at a low cost.

According to a first aspect of the invention, there is provided a running gear for a rail vehicle, comprising:

- at least a pair of wheel sets comprising a front wheel set and a rear wheel set respectively on a front side and a rear side of a median transverse vertical plane of the running gear, each of the front wheel set and rear wheel set having a left wheel and a right wheel, respectively on a left side and a right side of a median longitudinal vertical plane of the running gear, and
- a passive hydraulic wheel set steering system comprising:
  - a front left hydro-mechanical converter assembly for converting motion of the left wheel of the front wheel set towards and away from the median transverse vertical plane into hydraulic energy and vice versa, a front right hydro-mechanical converter assembly for converting motion of the right wheel of the front wheel set towards and away from the median transverse vertical plane into hydraulic energy and vice versa, a rear left hydro-mechanical converter assembly for converting motion of the left wheel of the rear wheel set towards and away from the median transverse vertical plane into hydraulic energy and vice versa, a rear right hydro-mechanical converter assembly for converting motion of the right wheel of the rear wheel set towards and away from the median transverse vertical plane into hydraulic energy and vice versa, and
  - a control valve assembly hydraulically connected to the front left, front right, rear left and rear right hydro-mechanical converter assemblies, the control valve assembly being movable between at least a first position and a second position, the passive hydraulic wheel set steering system being such that in the first position of the control valve assembly the front left and right hydro-left and right hydro-mechanical converter assemblies so as to allow movements of the left and right wheels of the front wheel set towards or away from the median transverse vertical plane and movements of the left and right wheels of the rear wheel set towards or away from the median transverse vertical plane that are independent from the movements of the left and right wheels of the front wheel set, and wherein in the second position of the control valve assembly, each of the front left and right hydro-mechanical converter assemblies is connected to at least a respective one of the rear left and right hydro-mechanical converter assemblies.

In the first position of the control valve assembly, there is no hydraulic connection, i.e. no transfer of hydraulic fluid or pressure, between the front hydro-mechanical converter assembly and the rear hydro-mechanical converter assembly. Accordingly, movements of the left and right wheels of the front wheel set towards or away from the median transverse vertical plane are independent of movements of the left and right wheels of the rear wheel set towards or away from the median transverse vertical plane. This first operation modus is particularly adapted to straight tracks and wide curves. In the second position of the control valve assembly, there is a transfer of pressure or hydraulic fluid between the hydro-mechanical converter assemblies of the front wheel set and the hydro-mechanical converter assemblies of the rear wheel set. This second operation modus is dedicated to tight curves. The structure of the hydraulic steering system is kept simple because it is passive, i.e. no pump or motor is involved in the motion of the hydro-mechanical converter assemblies, which are moved as a result of the external forces applied by the track on the wheels.

Preferably, the passive hydraulic wheel set steering system is such that at least in the first position of the control valve assembly, a motion of one of the left and right wheels of the front wheel set towards the median transverse vertical plane results in a motion of the other of the left and right wheels of the front wheel set away from the median transverse vertical plane, and a motion of one of the left and right wheels of the rear wheel set towards the median transverse vertical plane results in a motion of the other of the left and right wheels of the rear wheel set away from the median transverse vertical plane. Preferably, the passive hydraulic wheel set steering system is such that in the first position of the control valve assembly, the motion of one of the front wheels towards the median transverse vertical plane has the same magnitude as the motion of the other front wheel away from the median transverse vertical plane and the motion of one of the rear wheels towards the median transverse vertical plane has the same magnitude as the motion of the other rear wheel away from the median transverse vertical plane.

According to a preferred embodiment, the passive hydraulic wheel set steering system is such that at in the second position of the control valve assembly, a motion of one of the left and right wheels of the front wheel set towards the median transverse vertical plane results in a motion of the other of the left and right wheels of the front wheel set away from the median transverse vertical plane, and a motion of one of the left and right wheels of the rear wheel set towards the median transverse vertical plane results in a motion of the other of the left and right wheels of the rear wheel set away from the median transverse vertical plane. The passive hydraulic wheel set steering system is preferably such that in the second position of the control valve assembly, the motion of one of the front wheels towards the median transverse vertical plane has the same magnitude as the motion of the other front wheel away from the median transverse vertical plane and the motion of one of the rear wheels towards the median transverse vertical plane has the same magnitude as the motion of the other rear wheel away from the median transverse vertical plane.

Preferably, the passive hydraulic wheel set steering system is such that in the second position of the control valve assembly movements of the left, respectively right wheel of the front wheel set towards, respectively away from the median transverse vertical plane result in movements of the left, respectively right wheel of the rear wheel set towards, respectively away from the median transverse vertical plane. Preferably, the passive hydraulic wheel set steering system is such that in the second position of the control valve assembly movements of the left, respectively right wheels of the front wheel set towards, respectively away from the median transverse vertical plane result in movements of the same magnitude of the left, respectively right wheels of the front wheel set towards, respectively away from the median transverse vertical plane.

According to a preferred embodiment, the passive hydraulic wheel set steering system is such that in the first position of the control valve assembly, the front left and right hydro-mechanical converter assemblies are connected to one another and the rear left and right hydro-mechanical converter assemblies are connected to one another.

According to one embodiment, the passive hydraulic wheel set steering system is such that in the second position of the control valve assembly, the front left and right hydro-mechanical converter assemblies are disconnected from one another and the rear left and right hydro-mechanical converter assemblies are disconnected from one another.

According to an alternative embodiment, the passive hydraulic wheel set steering system is such that in the second position of the control valve assembly, the front left and right hydro-mechanical converter assemblies are connected with one another and the rear left and right hydro-mechanical converter assemblies are connected with one another.

Preferably, the passive hydraulic wheel set steering system is such that in the second position of the control valve assembly, the front left and rear left hydro-mechanical converter assemblies are connected to one another and the front right and rear right hydro-mechanical converter assemblies are connected to one another.

According to one embodiment, the passive hydraulic wheel set steering system is such that in the second position of the control valve assembly, the front left and rear right hydro-mechanical converter assemblies are connected to one another and the front right and rear left hydro-mechanical converter assemblies are connected to one another.

Each hydro-mechanical converter assembly is able to convert a mechanical energy resulting from a motion of the associated wheel towards or away from the median transverse vertical plane into hydraulic energy and to convert hydraulic energy back into mechanical energy for moving the associated wheel towards or away from the median transverse vertical plane. Each hydro-mechanical converter assembly may comprise one or more double acting hydro-mechanical converters s e.g. cylinders and/or one or more single acting hydro-mechanical converters e.g. cylinders. According to a preferred embodiment, each hydro-mechanical converter assembly consists of a single double acting hydraulic cylinder. According to another preferred embodiment, each hydro-mechanical converter assembly consists of two single acting hydraulic cylinders, one for hydraulically converting movements of the associated wheel towards the median transverse vertical plane and the other for hydraulically converting movements of the associated wheel away from the median transverse vertical plane.

According to one embodiment, the control valve assembly may consist in single two-position control valve. However, alternative with more than one valve are also possible. The control valve assembly may be actuated by any know electric, mechanic, pneumatic or hydraulic control means, in function of a signal which can be representative e.g. of the vehicle speed, lateral acceleration, radius of curvature of the track, position of the running gear with respect to the car body or can be a function of one or more of these variables.

According to a preferred embodiment, the left and right wheels of the front wheel set are supported on a common front wheel axle and the left and right wheels of the rear wheel set are supported on a common rear wheel axle. The wheel axles may have a fixed vertical pivot axis materialised by a pivot or an imaginary vertical pivot axis. Alternatively, each wheel set can consist of individual left and right wheels without a common axle, as disclosed e.g. in US 2010/0294163.

According to a preferred embodiment, the running gear is a bogie with at least two wheel sets, and comprises a bogie frame supported on the pair of wheel sets by means of a primary suspension.

According to one embodiment, at least one of the front wheel axle and rear wheel axle is pivotally connected to the frame of the running gear via a mechanical pivot for pivoting the said one of the front wheel axle and rear wheel axle about a fixed vertical rotation axis. Alternatively, the frame of the running gear is pivotally connected to the frame of the running gear without a mechanical pivot for pivoting the said one of the front wheel axle and rear wheel axle about a fixed vertical rotation axis.

According to another aspect of the invention, there is provided rail vehicle comprising a plurality of running gears as described hereinbefore.

BRIEF DESCRIPTION OF THE FIGURES

Other advantages and features of the invention will then become more clearly apparent from the following description of a specific embodiment of the invention given as non-restrictive examples only and represented in the accompanying drawings in which.

Corresponding reference numerals refer to the same or corresponding parts in each of the figures.

DETAILED DESCRIPTION OF PREFERRED EMBODIMENTS

Figure 1:
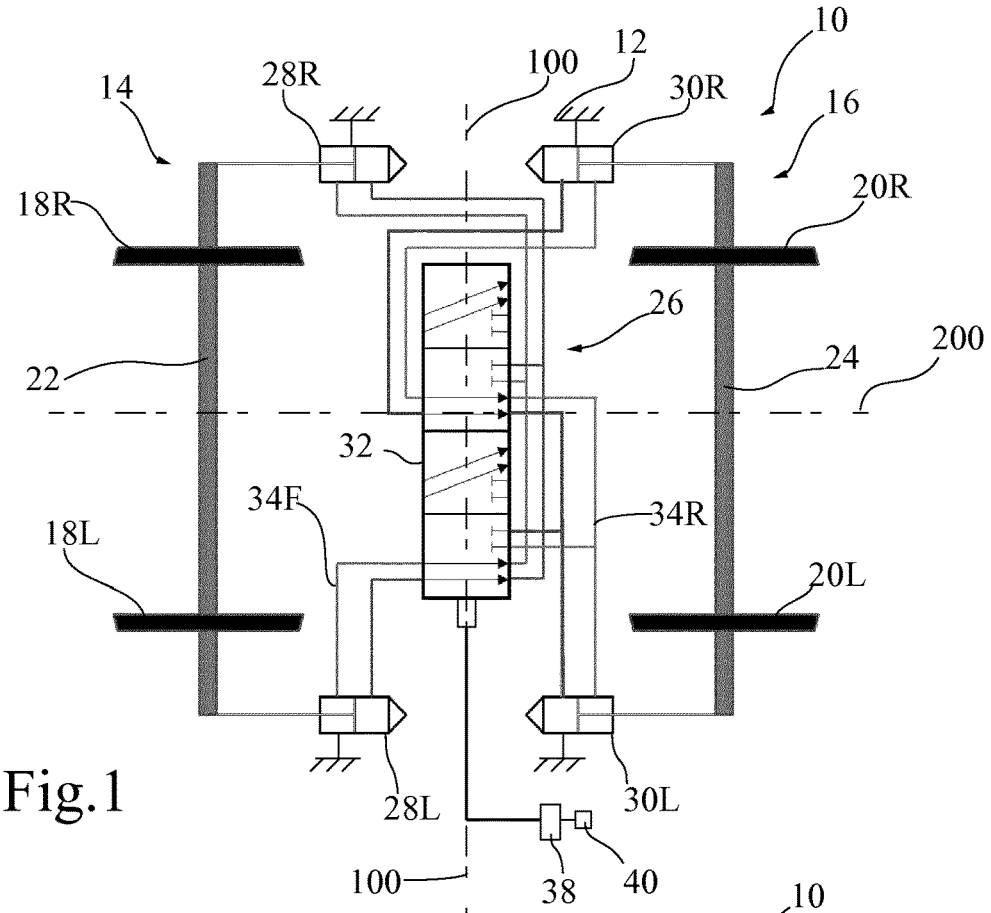
FIG. 1 is a diagrammatic illustration of a running gear of a rail vehicle according to a first embodiment of the invention, in a first operating mode.
Figure 2:
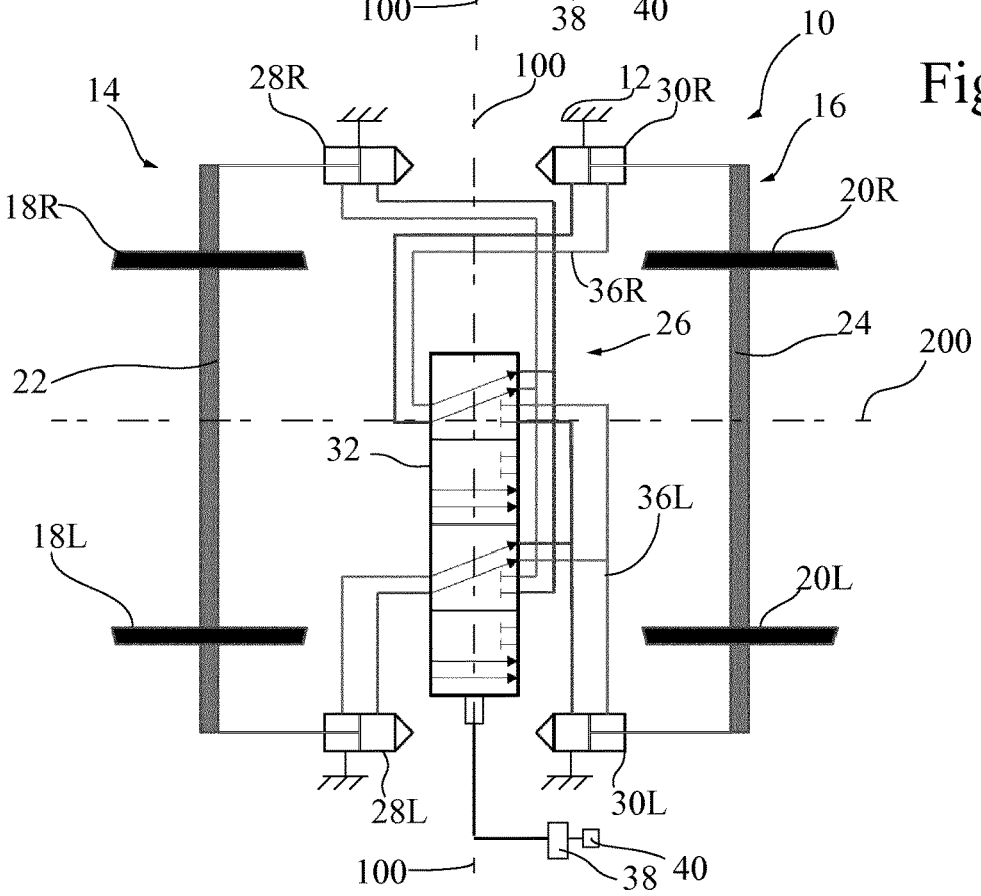
FIG. 2 is a diagrammatic illustration of the running gear according to the first embodiment of the invention, in a second operating mode.

With reference to FIGS. 1 and 2, a running gear 10, more specifically a bogie, of a rail vehicle comprises a bogie frame 12 supported on a pair of front and rear wheel sets 14, 16 by means of a primary suspension (not shown). The front wheel set 14 and the rear wheel set 16 are located respectively on a front side and a rear side of a median transverse vertical plane 100 of the running gear 10. Each of the front wheel set 14 and rear wheel set 16 comprises a left wheel 18L, 20L and a right wheel 18R, 20R, respectively on a left side and a right side of a median longitudinal vertical plane 200 of the running gear 10, and an axle 22, resp. 24 on which the left and right wheels 18L, 18R, resp. 20L, 20R are mounted (or which can be integral with the left and right wheels). Each axle 22, 24 can be a drive axle or a dead axle.

The bogie 10 is further provided with a passive hydraulic wheel set steering system 26 comprising: a front left hydro-mechanical converter assembly 28L consisting of a single double-acting cylinder for converting motion of the left wheel 18L of the front wheel set 14 towards and away from the median transverse vertical plane 100 into hydraulic energy and vice versa, a front right hydro-mechanical converter assembly 28R consisting of a single double-acting cylinder for converting motion of the right wheel 18R of the front wheel set 14 towards and away from the median transverse vertical plane 100 into hydraulic energy and vice versa, a rear left hydro-mechanical converter assembly 30L consisting of a single double-acting cylinder for converting motion of the left wheel 20L of the rear wheel set 16 towards and away from the median transverse vertical plane 100 into hydraulic energy and vice versa, and a rear right hydro-mechanical converter assembly 30R consisting of a single double-acting cylinder for converting motion of the right wheel 20R of the rear wheel set 16 towards and away from the median transverse vertical plane 100 into hydraulic energy and vice versa.

The passive hydraulic wheel set steering system 26 further comprises control valve assembly 32 which is depicted as a single twelve-port two-position control valve 32 hydraulically connected to the front left, front right, rear left and rear right hydraulic cylinders by means of hydraulic lines. More specifically, each hydraulic cylinder comprises a front and a rear chamber and each chamber is connected by a direct line to one or two of the ports of the control valve 32.

The control valve 32 is movable between a first position depicted in FIG. 1 and a second position depicted in FIG. 2.

In the first position of the control valve 32 in FIG. 1, the front left and right hydraulic cylinders 28L, 28R are isolated from the rear left and right hydraulic cylinders 30L, 30R, and two fully independent hydraulic circuits are formed, namely a front circuit 34F between the two hydraulic cylinders 28L, 28R of the front wheel set 14 and a rear circuit 34R between the two hydraulic cylinders of the rear wheel set 16. More specifically, the front chambers (i.e. the chambers closest to the front of the bogie 10, towards the left in FIG. 1) of the left and right hydraulic cylinders 28L, 28R of the front wheel set 14 are connected to one another, the rear chambers (i.e. the chambers closest to the rear of the bogie 10, towards the right in FIG. 1) of the left and right hydraulic cylinders 28L, 28R of the front wheel set 14 are connected to one another, the front chambers of the left and right hydraulic cylinders 30L, 30R of the rear wheel set 16 are connected to one another and the rear chambers of the left and right hydraulic cylinders 30L, 30R of the rear wheel set 16 are connected to one another. Hence, a motion of one of the left and right wheels 18L, 18R of the front wheel set 14 towards the median transverse vertical plane 100 due to the contact forces between the wheels 18L, 18R and the track results in a coordinated motion of the other of the left and right wheels 18L, 18R of the front wheel set 14 away from the median transverse vertical plane 100, and a motion of one of the left and right wheels 20L, 20R of the rear wheel set 16 towards the median transverse vertical plane 100 results in a motion of the other of the left and right wheels 20L, 20R of the rear wheel set 16 away from the median transverse vertical plane 100

In the second position of the control valve 32 in FIG. 2, the front left and rear left hydraulic cylinders 28L, 30L are connected to one another and disconnected from the front right and rear right hydraulic cylinders 28R, 30R, which are connected to one another. Two independent hydraulic circuits are formed, namely a left circuit 36L for the hydraulic cylinders 28L, 30L on the left side of the median longitudinal vertical plane 200 and a right circuit 36R for the hydraulic cylinders 28R, 30R on the right side of the median longitudinal vertical plane 200. More specifically, the front chambers of the hydraulic cylinders 28L, 30L of the front wheel set 14 and rear wheel set 16 on the left side of the median longitudinal vertical plane 200 are connected with one another, as are the rear chambers of the hydraulic cylinders 28L, 30L of the front wheel set 14 and rear wheel set 16 on the left side of the median longitudinal vertical plane 200. The same applies to the right side. With these connections, the steering motion of the front wheel set 14 is coordinated with the steering motion of rear wheel set 16. Hence, a motion of the wheel 18L of the front wheel set 14 towards (respectively away from) the median transverse vertical plane 100 due to the contact forces between the wheels 18L, 18R and the track results in a coordinated motion of left wheel 20L of the rear wheel set 16 towards (respectively away from) the median transverse vertical plane 100, and a motion of the right wheel 18R of the front wheel set 14 towards (respectively away from) the median transverse vertical plane 100 results in a motion of the right wheel 20R of the rear wheel set 16 towards (respectively away from) the median transverse vertical plane 100.

The control valve 32 is an electrically operated valve connected to a control unit 38, which may receive signals from various sensors 40, e.g. a GPS unit, a lateral accelerometer, a vehicle speed sensor, to switch the control valve 32 between a "straight" operating mode corresponding to the position of the control valve 32 in FIG. 1 and a "tight curve" operating mode corresponding to the position of the control valve 32 in FIG. 2.

The passive hydraulic wheel set steering system 26 operates as follows. In the "straight" operating mode of FIG. 1, the front and rear wheel sets 14, 16 are independent of one another. The front hydraulic circuit 34F allows coordinated movement of the left and right wheels 18L, 18R of the front wheel set 14 about a front imaginary vertical pivot axis located in the median longitudinal vertical plane 200. Similarly, the rear hydraulic circuit 34R allows coordinated movement of the left and right wheels 20L, 20R of the rear wheel set 16 about a rear imaginary vertical pivot axis located in the median longitudinal vertical plane 200 and spaced apart from the front imaginary pivot axis. Because the rotation motion of the front wheel set 14 about the front imaginary vertical pivot axis is independent of the rotation of the rear wheel set 16 about the rear imaginary vertical pivot axis, each wheel set can find its own optimal (slightly over-radial) position in a wide curve.

In the "tight curve" operating mode, the left circuit 36L enables coordinated motion of the left wheels 18L, 20L of the front and rear wheel sets 14, 16 such that a motion of the front wheel 18L towards (resp. away from) the median transverse vertical plane 100 results in a coordinated motion of the same amplitude of the rear wheel 20L towards (resp. away from) the median transverse vertical plane 100. Similarly, the right circuit 36R enables coordinated motion of the right wheels 18R, 20R of the front and rear wheel sets 14, 16 such that a motion of the front wheel 18R towards (resp. away from) the median transverse vertical plane 100 results in a coordinated motion of the same amplitude of the rear wheel 20R towards (resp. away from) the median transverse vertical plane 100. However, the left and right circuits 36L, 36F remain independent, which means that the instantaneous motion of each wheel set 14, 16 can be a combination of a rotation about an imaginary instantaneous vertical pivot axis (which is not necessarily located in the median longitudinal vertical plan 200) and a translation in the longitudinal direction towards or away from the median transverse vertical plane 100. While the number of degrees of freedom is the same in the two modes, the "tight curve" operating mode provides a coordination between the front and rear wheel sets 14, 16 which ensure that a rotation of the front wheel set 14 in one direction about a vertical axis, caused by the reaction of the wheels rolling on the track, will result in a rotation of the rear wheel set 16 in an opposite direction, which is beneficial in tight curves.

Switching the valve from one operating mode to the other does not compromise the steering performance. In a transition from a straight track or wide curve to a tight curve, the steering system is initially in the "straight" operating mode and the wheel set are free to pivot in a slightly over-radial position before the control valve 32 is switched to the "tight curve" operating mode. Once the control valve 32 has been switched to the "tight curve" operating mode, the subsequent rotations of the front and rear wheel sets are coordinated. In a transition from a tight curve back to a straight track, the two wheel sets 14, 16 return to a straight position before the steering system is switched from the "tight curve" operating mode back to the "straight" operating mode.

Figure 3:
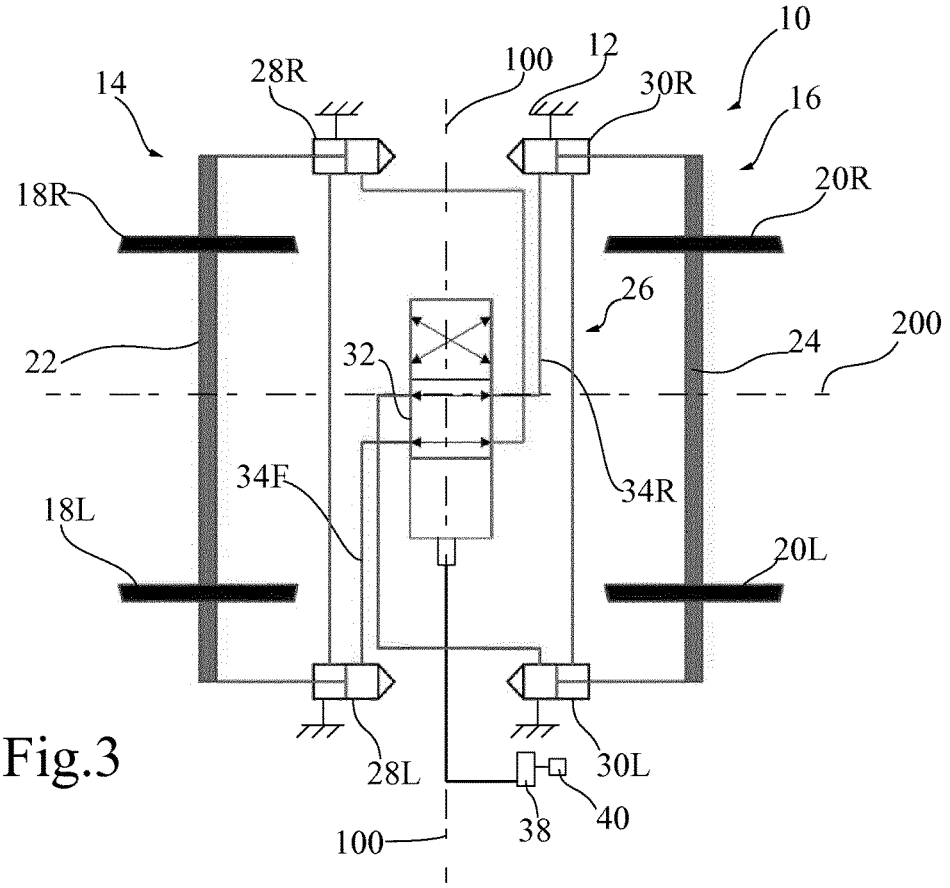
FIG. 3 is a diagrammatic illustration of a running gear of a rail vehicle according to a second embodiment of the invention, in a first operating mode.
Figure 4:
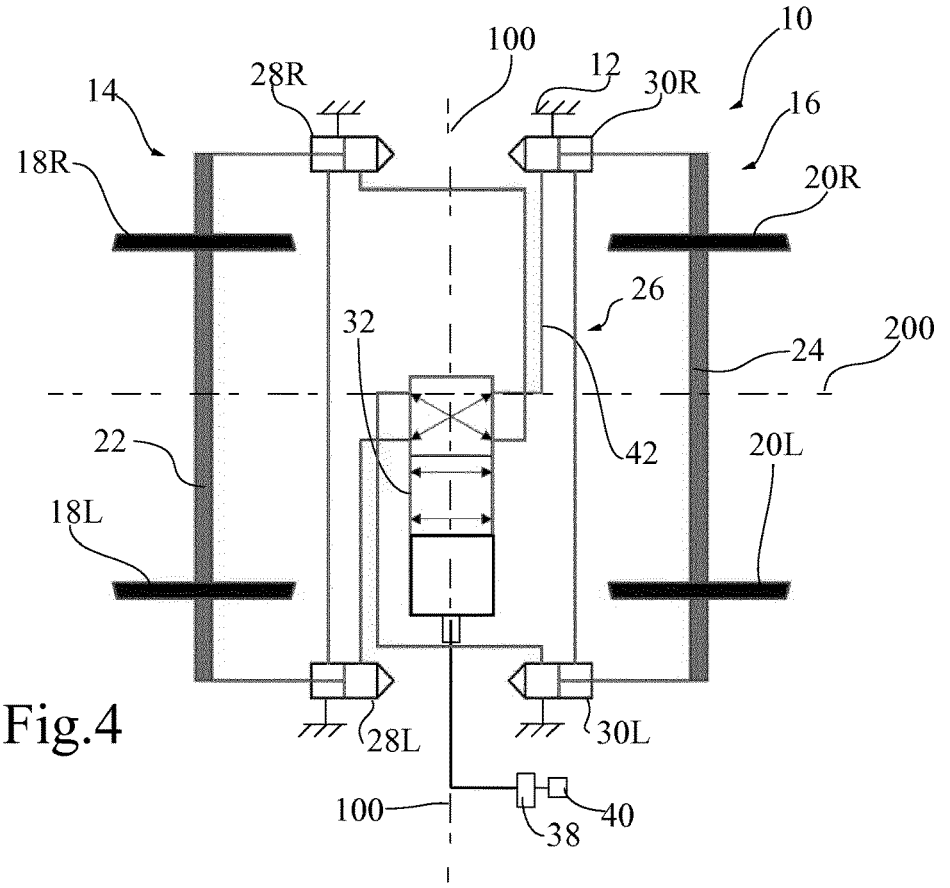
FIG. 4 is a diagrammatic illustration of the running gear according to the second embodiment of the invention, in a second operating mode.

The running gear 10 illustrated in FIGS. 3 and 4 is similar to the running gear of FIGS. 1 and 2 and reference is made to the description of the structure of the running gear of FIGS. 1 and 2 to avoid duplication. The only difference between both assemblies resides in the control valve assembly 32 and hydraulic lines linking the front left, front right, rear left and rear right hydraulic cylinders 28L, 28R, 30L, 30R. The control valve assembly 32 consists of a single four-port two-position or three-position control valve, which is connected to the rear chambers of the two hydraulic cylinders 28L, 28R of the front wheel set 14 and to the front chambers of the two hydraulic cylinders 30L, 30R of the rear wheel set 16. The front chambers of the left and right hydraulic cylinders 28L, 28R of front wheel set 14 are permanently connected with one another. Similarly, the rear chambers of the left and right hydraulic cylinders 30L, 30R of rear wheel set 16 are permanently connected with one another.

The control valve 32 is movable between a first position depicted in FIG. 3 and a second position depicted in FIG. 4.

In the first position of the control valve 32 in FIG. 3, the front left and right hydraulic cylinders 28L, 28R are isolated from the rear left and right hydraulic cylinders 30L, 30R, and two fully independent hydraulic circuits are formed, which are functionally identical with the circuits FIG. 1, namely a front circuit 34F between the two hydraulic cylinders 28L, 28R of the front wheel set 14 and a rear circuit 34R between the two hydraulic cylinders of the rear wheel set 16.

In the second position of the control valve in FIG. 4, a crossed hydraulic circuit 42 is formed. The rear chamber of the left hydraulic cylinder 28L of the front wheel set 14 is connected with the front chamber of the right hydraulic cylinder 30R of the rear wheel set 16, while the rear chamber of the right hydraulic cylinder 28R of the front wheel set 14 is connected with the front chamber of the left hydraulic cylinder 30L of the rear wheel set 16. As the front chambers of the left and right hydraulic cylinders 28L, 28R of front wheel set 14 are still connected with one another and the rear chambers of the left and right hydraulic cylinders 30L, 30R of rear wheel set 16 are connected with one another, the hydraulic system has only one degree of freedom, i.e. the front and rear wheel sets 14, 16 can only rotate about their respective imaginary vertical pivot axis in opposite directions.

The control valve 32 can be operated between a "straight" operating mode, which corresponds to the position of the control valve 32 in FIG. 3 and is identical with the "straight" operating mode discussed in connection with FIG. 1, and a "tight curve" operating mode, which corresponds to the position of the control valve 32 in FIG. 4.

In the "tight curve" operating mode, the direct connection between the front chambers of the left and right hydraulic cylinders 28L, 28R of the front wheel set 14 ensures that a motion of the left wheel 18L of the front wheel set 14 towards (respectively away from) the median transverse vertical plane 100 will result in a motion of the same amplitude of the right wheel 18R of the front wheel set 14 away from (respectively towards) the median transverse vertical plane 100. Accordingly, the motion of the front wheel set 14 is necessarily a rotation motion about a front imaginary vertical pivot axis located in the median longitudinal vertical plan 200. Similarly, the motion of the rear wheel set 16 is necessarily a rotation motion about a rear imaginary vertical pivot axis located in the median longitudinal vertical plan 200. The motions of the front and rear wheel sets 14, 16 are coordinated and opposed, i.e. a rotation of the front wheel set 14 in one direction will result in a rotation of the rear wheel set 16 in the opposite direction.

While the above examples illustrate preferred embodiments of the present invention it is noted that various other arrangements can also be considered.

As a variant of the first embodiment, one of the wheel sets may be mechanically connected to the bogie frame via a mechanical pivot connection, which defines a fixed vertical pivot axis. This fixed pivot axis does not modify the behaviour of the steering system in the "straight" operating mode, but prevent translation motions of the wheel sets in the "tight curve" operating mode. It is not necessary to provide one mechanical pivot connection for each wheel set, since the motion the front and rear wheel sets 14, 16 in the "tight curve" operating mode are hydraulically coordinated.

The control valve 32 can be mechanically or hydraulically operated, e.g. via an inertia mass allowed to move transversally with respect to the bogie frae 12.

Each hydro-mechanical converter assembly 28L, 28R, 30L, 30R may consist of two single-acting cylinders with or without return spring. They may also consist of piston converters as disclosed e.g. in WO 2007/090825.

The control valve assembly 32 may consist of several valves. The passive hydraulic wheel set steering system 26 may include hydraulic damping means, e.g. restrictions, to stabilise the yawing movement of the wheel sets.

The passive hydraulic wheel set steering system 26 is a passive system insofar as it does not involve a pump for steering the wheel sets 14, 16. This does not mean however, that the hydraulic system has to be hydraulically isolated. A connection to a pump and a tank may be required to compensate leaks in the hydraulic circuits.

The running gear is not necessarily a bogie. The hydro-mechanical converter assembly 28L, 28R, 30L, 30R can for instance be directly fixed to an underframe of a railway carriage, without intermediate bogie frame.

While the passive hydraulic wheel set steering system 26 has been applied to a two-axle bogie, other kinds of running gears may also benefit from it, in particular three-axle bogie with an additional median, non-steerable axle.

The invention claimed is:

1. A running gear for a rail vehicle, comprising:

at least a pair of wheel sets comprising a front wheel set and a rear wheel set respectively on a front side and a rear side of a median transverse vertical plane of the running gear, each of the front wheel set and rear wheel set having a left wheel and a right wheel, respectively on a left side and a right side of a median longitudinal vertical plane of the running gear, and passive hydraulic wheel set steering system comprising: a front left hydro-mechanical converter assembly for converting motion of the left wheel of the front wheel set towards and away from the median transverse vertical plane into hydraulic energy and vice versa, a front right hydro-mechanical converter assembly for converting motion of the right wheel of the front wheel set towards and away from the median transverse vertical plane into hydraulic energy and vice versa, a rear left hydro-mechanical converter assembly for converting motion of the left wheel of the rear wheel set towards and away from the median transverse vertical plane into hydraulic energy and vice versa, a rear right hydro-mechanical converter assembly for converting motion of the right wheel of the rear wheel set towards and away from the median transverse vertical plane into hydraulic energy and vice versa, wherein the passive hydraulic wheel set steering system further comprises a control valve assembly hydraulically connected to the front left, front right, rear left, and rear right hydro-mechanical converter assemblies, the control valve assembly being movable between at least a first position and a second position, the passive hydraulic wheel set steering system being such that in the first position of the control valve assembly the front left and right hydro-mechanical converter assemblies are disconnected from the rear left and right hydro-mechanical converter assemblies so as to allow movements of the left and right wheels of the front wheel set towards or away from the median transverse vertical plane and movements of the left and right wheels of the rear wheel set towards or away from the median transverse vertical plane that are independent from the movements of the left and right wheels of the front wheel set, and wherein in the second position of the control valve assembly, each of the front left and right hydro-mechanical converter assemblies is connected to at least a respective one of the rear left and right hydro-mechanical converter assemblies.

2. The running gear of claim 1, wherein the passive hydraulic wheel set steering system is such that at least in the first position of the control valve assembly, a motion of one of the left and right wheels of the front wheel set towards the median transverse vertical plane results in a motion of the other of the left and right wheels of the front wheel set away from the median transverse vertical plane, and a motion of one of the left and right wheels of the rear wheel set towards the median transverse vertical plane results in a motion of the other of the left and right wheels of the rear wheel set away from the median transverse vertical plane.

3. The running gear of claim 2, wherein the passive hydraulic wheel set steering system is such that in the second position of the control valve assembly, a motion of one of the left and right wheels of the front wheel set towards the median transverse vertical plane results in a motion of the other of the left and right wheels of the front wheel set away from the median transverse vertical plane, and a motion of one of the left and right wheels of the rear wheel set towards the median transverse vertical plane results in a motion of the other of the left and right wheels of the rear wheel set away from the median transverse vertical plane.

4. The running gear of claim 3, wherein the passive hydraulic wheel set steering system is such that in the second position of the control valve assembly, movements of the left, respectively right wheel of the front wheel set towards, respectively away from the median transverse vertical plane result in movements of the left, respectively right wheel of the rear wheel set towards, respectively away from the median transverse vertical plane, movements of the left wheel of the front wheel set away from the median transverse vertical plane result in movements of the left wheel of the rear wheel set away from the median transverse vertical plane, movements of the right wheel of the front wheel set towards the median transverse vertical plane result in movements of the right wheel of the rear wheel set towards the median transverse vertical plane, and movements of the right wheel of the front wheel set away from the median transverse vertical plane result in movements of the right wheel of the rear wheel set away from the median transverse vertical plane.

5. The running gear of claim 3, wherein the passive hydraulic wheel set steering system is such that in the first position of the control valve assembly, the front left and right hydro-mechanical converter assemblies are connected to one another and the rear left and right hydro-mechanical converter assemblies are connected to one another.

6. The running gear of claim 2, wherein the passive hydraulic wheel set steering system is such that in the second position of the control valve assembly movements of the left wheel of the front wheel set towards the median transverse vertical plane result in movements of the left wheel of the rear wheel set towards the median transverse vertical plane, movements of the left wheel of the front wheel set away from the median transverse vertical plane result in movements of the left wheel of the rear wheel set away from the median transverse vertical plane, movements of the right wheel of the front wheel set towards the median transverse vertical plane result in movements of the right wheel of the rear wheel set towards the median transverse vertical plane, and movements of the right wheel of the front wheel set away from the median transverse vertical plane result in movements of the right wheel of the rear wheel set away from the median transverse vertical plane.

7. The running gear of claim 2, wherein the passive hydraulic wheel set steering system is such that in the first position of the control valve assembly, the front left and right hydro-mechanical converter assemblies are connected to one another and the rear left and right hydro-mechanical converter assemblies are connected to one another.

8. The running gear of claim 2, wherein the passive hydraulic wheel set steering system is such that in the second position of the control valve assembly, the front left and right hydro-mechanical converter assemblies are disconnected from one another and the rear left and right hydro-mechanical converter assemblies are disconnected from one another.

9. The running gear of claim 1, wherein the passive hydraulic wheel set steering system is such that in the second position of the control valve assembly movements of the left wheel of the front wheel set towards the median transverse vertical plane result in movements of the left wheel of the rear wheel set towards the median transverse vertical plane, movements of the left wheel of the front wheel set away from the median transverse vertical plane result in movements of the left wheel of the rear wheel set away from the median transverse vertical plane, movements of the right wheel of the front wheel set towards the median transverse vertical plane result in movements of the right wheel of the rear wheel set towards the median transverse vertical plane, and movements of the right wheel of the front wheel set away from the median transverse vertical plane result in movements of the right wheel of the rear wheel set away from the median transverse vertical plane.

10. The running gear of claim 9, wherein the passive hydraulic wheel set steering system is such that in the first position of the control valve assembly, the front left and right hydro-mechanical converter assemblies are connected to one another and the rear left and right hydro-mechanical converter assemblies are connected to one another.

11. The running gear of claim 1, wherein the passive hydraulic wheel set steering system is such that in the first position of the control valve assembly, the front left and right hydro-mechanical converter assemblies are connected to one another and the rear left and right hydro-mechanical converter assemblies are connected to one another.

12. The running gear of claim 1, wherein the passive hydraulic wheel set steering system is such that in the second position of the control valve assembly, the front left and right hydro-mechanical converter assemblies are disconnected from one another and the rear left and right hydro-mechanical converter assemblies are disconnected from one another.

13. The running gear of claim 1, wherein the passive hydraulic wheel set steering system is such that in the second position of the control valve assembly, the front left and right hydro-mechanical converter assemblies are connected with one another and the rear left and right hydro-mechanical converter assemblies are connected with one another.

14. The running gear of claim 1, wherein the passive hydraulic wheel set steering system is such that in the second position of the control valve assembly, the front left and rear left hydro-mechanical converter assemblies are connected to one another and the front right and rear right hydro-mechanical converter assemblies are connected to one another.

15. The running gear of claim 1, wherein the passive hydraulic wheel set steering system is such that in the second position of the control valve assembly, the front left and rear right hydro-mechanical converter assemblies are connected to one another and the front right and rear left hydro-mechanical converter assemblies are connected to one another.

16. The running gear of claim 1, wherein the left and right wheels of the front wheel set are supported on a common front wheel axle and the left and right wheels of the rear wheel set are supported on a common rear wheel axle.

17. The running gear of claim 16, wherein at least one of the front wheel axle and rear wheel axle is pivotally connected to a bogie frame of the running gear via a mechanical pivot for pivoting the said one of the front wheel axle and rear wheel axle about a fixed vertical rotation axis.

18. The running gear of claim 16, wherein a bogie frame of the running gear is pivotally connected to the bogie frame of the running gear without a mechanical pivot for pivoting the said one of the front wheel axle and rear wheel axle about a fixed vertical rotation axis.

19. The running gear of claim 1, further comprising a bogie frame supported on the pair of wheel sets by means of a primary suspension.

20. A rail vehicle comprising a plurality of running gears according to claim 1.

* * * * *